US005353893A

United States Patent [19]

Sun et al.

[11] Patent Number: 5,353,893

[45] Date of Patent: Oct. 11, 1994

[54] ELEVATOR CAB AND/OR COUNTERWEIGHT COMPENSATION ROPE HITCH ASSEMBLY

[75] Inventors: Lu Sun, Simsbury; Joseph R. Faust, Southington, both of Conn.

[73] Assignee: Otis Elevator Company, Farmington, Conn.

[21] Appl. No.: 90,380

[22] Filed: Jul. 12, 1993

[51] Int. Cl.[5] ..... B66B 9/00

[52] U.S. Cl. ..... 187/412; 24/136 K; 254/DIG. 14

[58] Field of Search ..... 187/1 R, 1 A, 20; 254/DIG. 14; 24/136 K, 136 R, 122.6; 403/334, 373, 211

[56] References Cited

U.S. PATENT DOCUMENTS 1,894,351 1/1933 Frost ..... 187/1 A

FOREIGN PATENT DOCUMENTS 853084 7/1949 Fed. Rep. of Germany ... 24/136 K
660357 2/1964 Italy ..... 24/122.6
1257049 9/1986 U.S.S.R. ..... 187/1 R
450994 7/1936 United Kingdom ..... 24/136 K

OTHER PUBLICATIONS

'Research Disclosure'; No. 169; May 1978.

*Primary Examiner*—Robert P. Olszewski
*Assistant Examiner*—Kenneth Noland

[57] ABSTRACT

Elevator compensation ropes are attached to the elevator cab frame by means of a wedge block which is mounted on a lower portion of the frame. The wedge block has a plurality of separate wedge-shaped passages thereon through which each of the compensation ropes passes upwardly. The ropes are looped over V-shaped inserts and then passed downwardly through the passages. The inserts are dropped into respective ones of the passages so as to wedge the ropes against the wedge block. The counterweight is connected to the compensation ropes with a plurality of rope deflectors which guide the ropes from a fanned out series of thimble rods to a closely spaced parallel rope array which extends from the counterweight into the hoistway pit.

6 Claims, 5 Drawing Sheets

ELEVATOR CAB AND/OR COUNTERWEIGHT COMPENSATION ROPE HITCH ASSEMBLY

TECHNICAL FIELD

This invention relates to an assembly for connecting compensation ropes to an elevator cab frame and counterweight, and more particularly to an assembly which can be readily adjusted to take into account rope stretch.

BACKGROUND ART

In high rise building elevator systems, the cab frame and the counterweight are interconnected by compensation ropes which descend in a loop down into the hoistway pit from the cab and counterweight. The compensation ropes balance the system to offset the weight of the traction cables in the elevator system. The compensation ropes do not support the weight of either the counterweight or cab assembly, as do the traction ropes, but merely provide an offsetting downward force on the cab or counterweight which balances the upward force imposed thereon by the weight of the traction cables.

At the present time, the compensation ropes are hitched to the cab frame by means of thimble rods and babbitted rope sockets; which, once installed, can only be adjusted within a limited range. This type of connection is perfectly acceptable from a strength standpoint, but is undesirable due to the relatively fixed nature of the connection. During extended operation of the elevator system, the traction ropes, and the compensation ropes (to a much smaller degree) will stretch, whereby the tensioning compensation sheave may be bottomed after a period of operation thereby resulting in a loss of tension and guidance on the compensation ropes. The normal load on each compensation rope is small (about 100 lbs.) and they stretch to a limited extent while the load on each hoist rope is rather large (about 1,500 lbs.) and there is considerable stretch. The only way to correct this problem is to adjust the length of the compensation ropes, which must be done relatively frequently. As noted previously, the babbitted rope sockets can only undergo limited adjustment, and in fact must be refitted and rebabbitted from time to time. This is time consuming, laborious and undesirable.

DISCLOSURE OF THE INVENTION

This invention relates to an improved compensation rope hitch assembly for use in an elevator system, where in the effective length of the compensation ropes can be easily and quickly adjusted to account for rope stretch during operation of the elevator. The compensation rope hitch assembly is connected at one end to the elevator cab frame and at the other end to the counterweight frame. The compensation ropes will typically be reeved about a tensioning guide sheave mounted on the hoistway pit floor.

The cab frame hitch assembly includes a wedge block which is mounted on the lower cross beam portion of the cab frame. The block includes a wedge-shaped vertical passage having a plurality of rope-receiving grooves formed therein. The ends of the compensation ropes are passed upwardly through respective ones of the grooves and looped back upon themselves and passed back down through the grooves. Each groove is provided with a wedge insert piece that is inserted into the loop of each of the compensation ropes. The ropes are then drawn downwardly and the individual wedge inserts are forced into the respective wedge block grooves. The wedge inserts thus jam the ropes in the wedge block to form a secure, but releasable connection between the ropes and the elevator cab frame. The downwardly depending free ends of each rope will be tied to the remainder of the respective ropes.

The counterweight hitch assembly will be formed with a modified wedge block/wedge insert combination which includes thimble rods connected to the counterweight frame. The thimble rods are connected to the counter-weight frame at transversely spaced-apart locations located evenly across approximately the middle third of the counterweight frame; when viewed in front elevation. The thimble rods are non-babbitted wedged rope hitch rods which are threaded into an individual wedge block so that there are a plurality of separate wedge blocks, as contrasted to the single wedge block preferred for use with the cab assembly. The end of each of the compensation ropes is thus passed upwardly through its own individual wedge block and then looped back upon itself and passed back down through the respective wedge block. A wedge insert is fitted into each of the rope loops and tightened down into each of the wedge blocks, as described above. The descending ropes are passed through individual rope-deflection blocks which are mounted on a frame below the wedge block/thimble rod assemblages. The deflection blocks receive the free ends of each rope, and also provide a controlled and supported deflection of each of the ropes toward a central bracket wherein the ropes are gathered and from which the ropes descend into the hoistway pit. The central bracket is mounted on a lower-most portion of the counterweight frame. The deflection blocks are secured to a transverse bar which counters compressive forces caused by the weight of the compensation ropes; and therefore protects the thimble rods from being bent inwardly.

It is therefore an object of this invention to provide an elevator compensation rope hitch assembly which can be readily adjusted to account for rope stretch which occurs during operation of the elevator.

It is a further object of this invention to provide a rope hitch assembly of the character described which can be adjusted without destroying any of the hitch components.

It is an additional object of this invention to provide a rope hitch assembly of the character described which provides controlled rope deflection on the counterweight.

These and other objects and advantages of this invention will become more readily apparent from the following detailed description of a preferred embodiment of the invention when taken in conjunction with the accompanying drawings, in which:

BEST MODE FOR CARRYING OUT THE INVENTION

Figure 1:
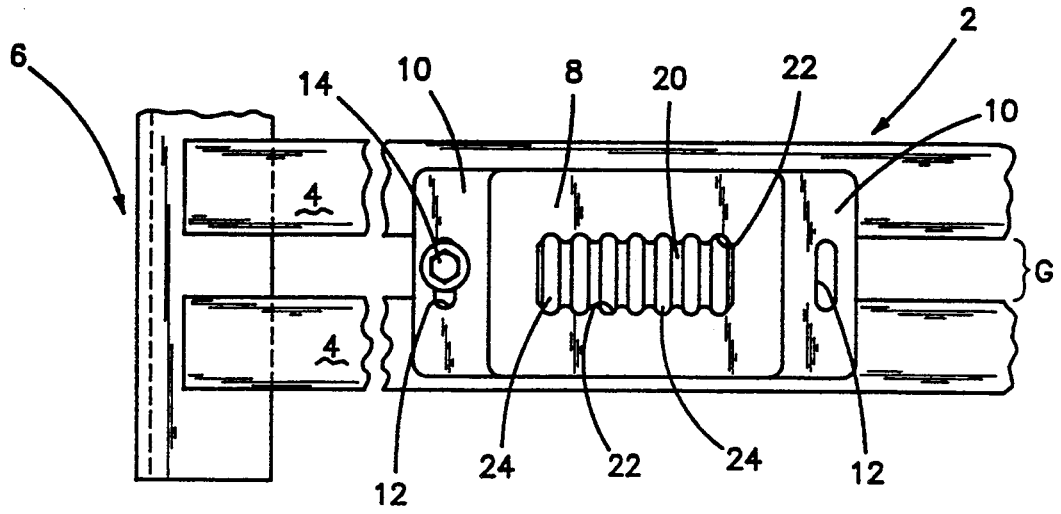
FIG. 1 is a fragmented plan view of a portion of the elevator cab frame showing an embodiment of the wedge block of this invention mounted thereon.
Figure 3:
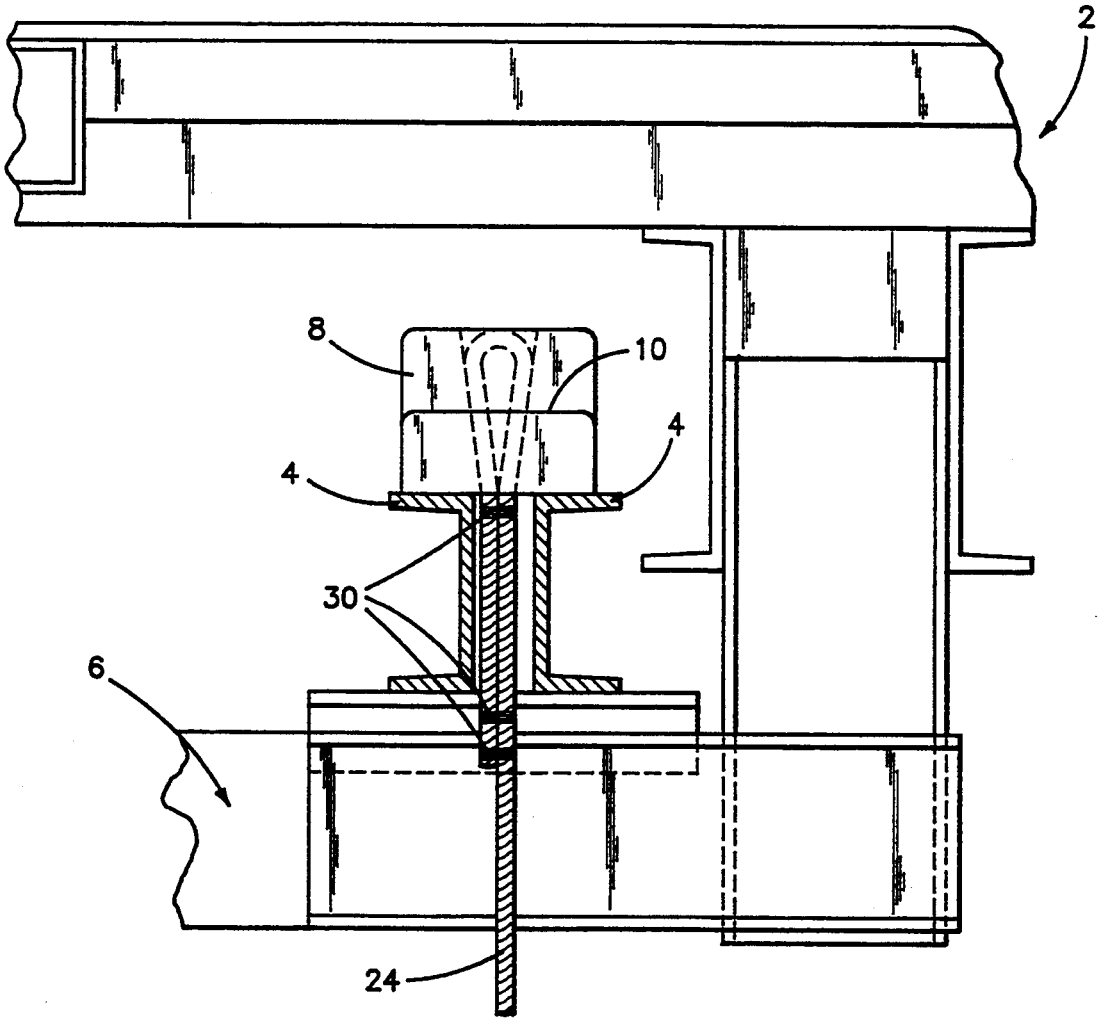
FIG. 3 is a fragmented sectional view of the assembly taken along line 3—3 of FIG. 2.
Figure 2:
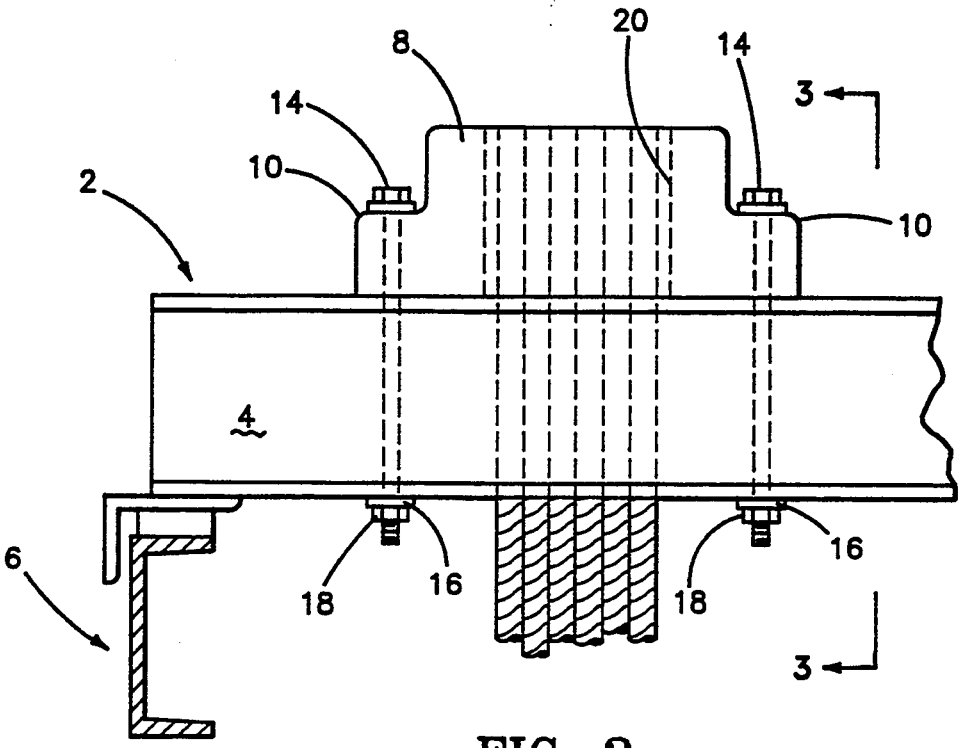
FIG. 2 is a fragmented front elevation of the assembly of FIG. 1.

Referring now to the drawings, details of an embodiment of the rope hitch for use on the elevator cab assembly are shown in FIGS. 1–5. The cab frame is indicated generally by the numeral 2, and includes a pair of beams 4 which extend transversely across the bottom of the frame 2, and the ends of which are supported by fore and aft beam assemblies 6. The beams 4 are spaced apart so as to provide a gap G therebetween.

A wedge block 8 is mounted on the beams 4 and bridges the gap G. The wedge block 8 has opposed shoulders 10 thereon which are provided with through passages 12 through which tie-down bolts 14 extend. The bolts 14 extend through the gap G and are secured to cross straps 16 by means of nuts 18 so as to fix the wedge block 8 to the beams 4. The wedge block 8 includes an elongated through slot 20 therein which is provided with a plurality of adjacent opposed groove pairs 22. There will be one groove pair 22 for each rope to be secured by the hitch assembly.

Figure 5:
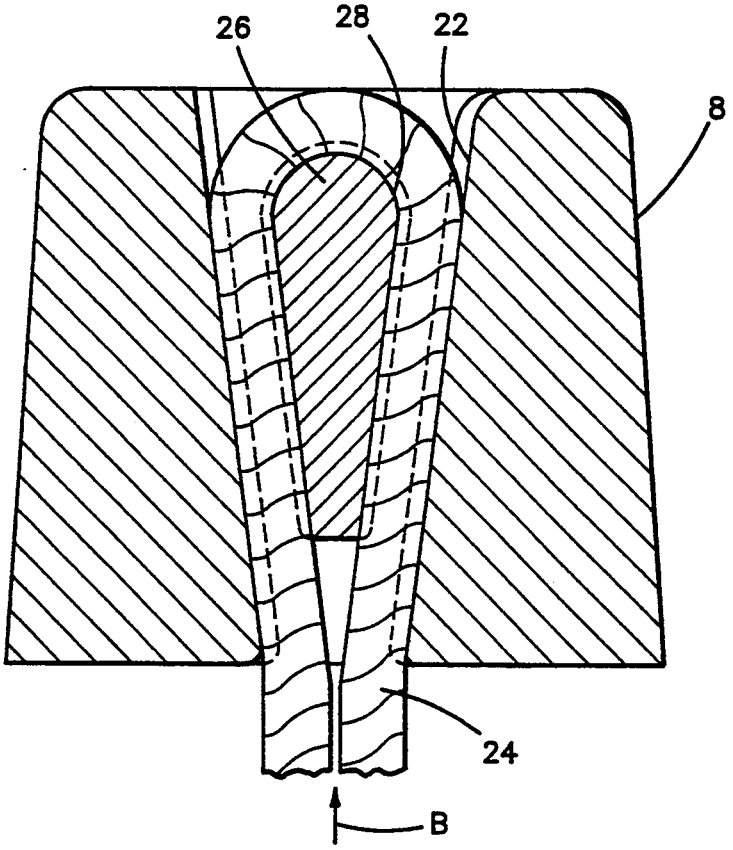
FIG. 5 is a sectional view of the assembly of FIG. 4 showing the wedge insert in place in the wedge block.
Figure 4:
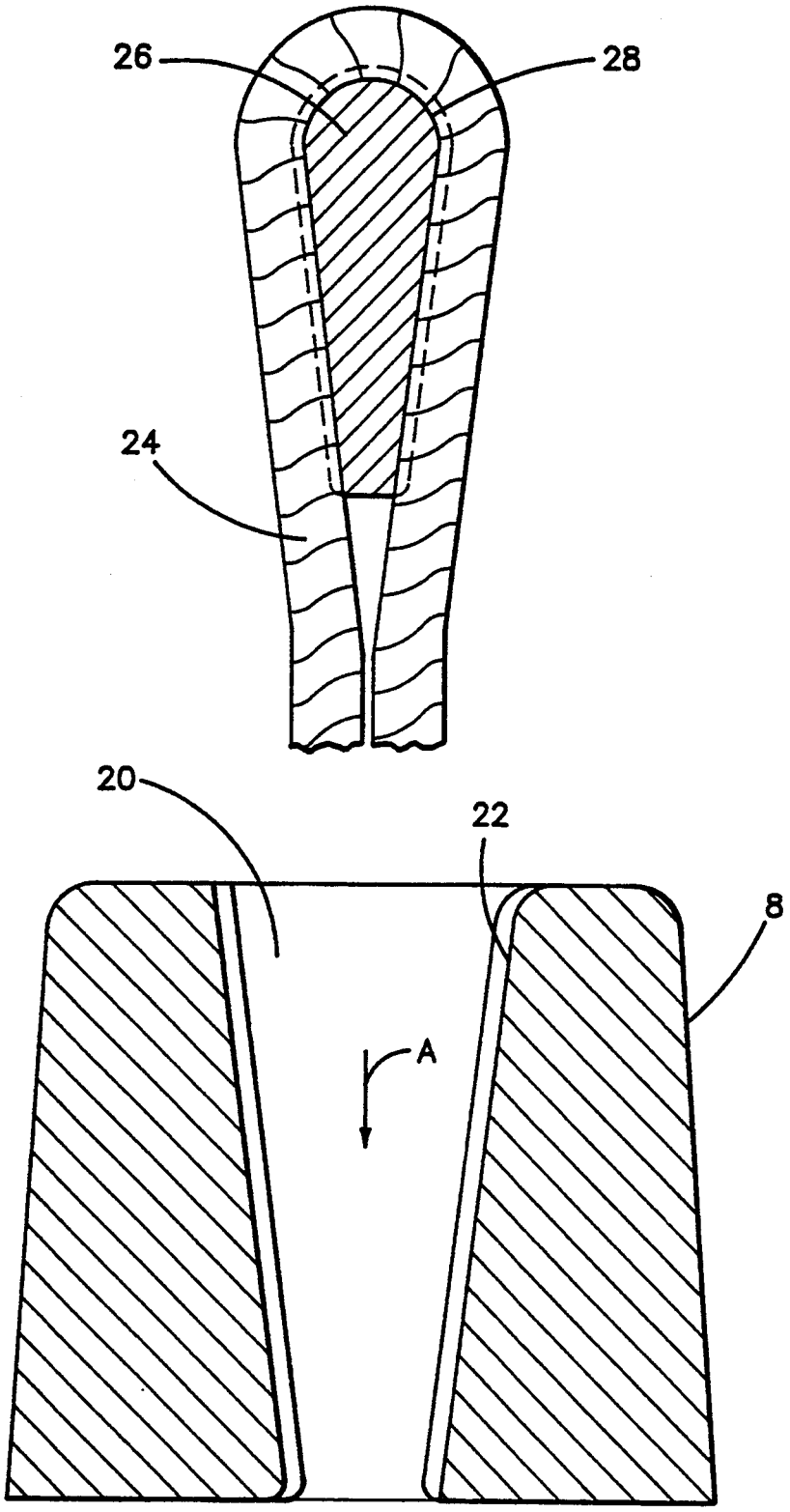
FIG. 4 is an exploded sectional view of the wedge block, wedge insert and compensation rope.

Details to the manner in which the individual ropes 24 are secured to the wedge block 8 are best shown in FIGS. 4 and 5. As seen in FIG. 4, the ropes 24 are passed upwardly through the wedge block slot 20, looped around respective wedge inserts 26, and then the free end of each rope 24 is passed back down through the slot 20. The wedge inserts 26 are each provided with outer concave surfaces 28 having a radius of curvature that matches the radius of the ropes 24. It will be appreciated that the slot grooves 22 may also be formed with a radius of curvature which essentially matches the radius of the ropes 24, or may be Vee shaped. Each of the rope 24/wedge 26 combinations is aligned with a respective one of the wedge block grooves 22, and the ropes 24 and wedge inserts 26 are moved downwardly in the direction of the arrow A in FIG. 4 until the wedge inserts 26 and ropes 24 nest in the wedge block slots 22, as shown in FIG. 5. It will be noted from FIG. 5, that the wedge inserts 26 will prevent the ropes 24 from being pulled downwardly out of the wedge block 8, whereby the ropes 24 will be firmly secured against downward movement relative to the wedge block 8. The exact angle of inclination of the wedge block slots 22 and the insert slots 28, and the dimensions of the slot 20 and inserts 26 will depend on the size of the ropes being hitched, and can be readily calculated to ensure firm securement, against downward displacement, while at the same time allowing for relatively easy upwardly directed disengagement displacement of the ropes 24 and inserts 26 from the wedge block 8. Thus it will be understood that displacement of the ropes 24 and inserts 26 in the direction of the arrow B in FIG. 5 will uncouple the hitch whereby adjustments to the rope loops can be made. The hitch can then be reestablished. It will be noted that the free ends of the ropes 24 can be lashed to the depending ropes, as shown at 30 in FIG. 3.

Referring now to FIGS. 6–10, details of a compensating rope hitch for the counterweight assembly are shown. The counterweight assembly is denoted generally by the numeral 34, and includes a frame 36 with inboard vertically extending rods 38 on which the counterweight weights 40 are mounted. The weights 40 are thus mounted inboard of the frame 36. The traction rope 42 is secured to the upper end of the counterweight frame 36. A mounting bracket 44 extends across the frame 36 and includes outwardly extending flanges 46 which provide outboard guides and supports for the compensation rope thimble rods 48. The thimble rods 48 are supported on the flanges 46 by means of nuts 50 threaded onto the thimble rods 48. Threaded onto the lower end of each thimble rod 48 is an individual wedge block 52 which has a lower platform part 54 provided with a tapered rope loop and wedge insert-receiving slot (not shown) which operates in accordance with the above-described principals, to provide a secure, yet adjustable hitch for each of the compensation ropes 24.

Figure 6:
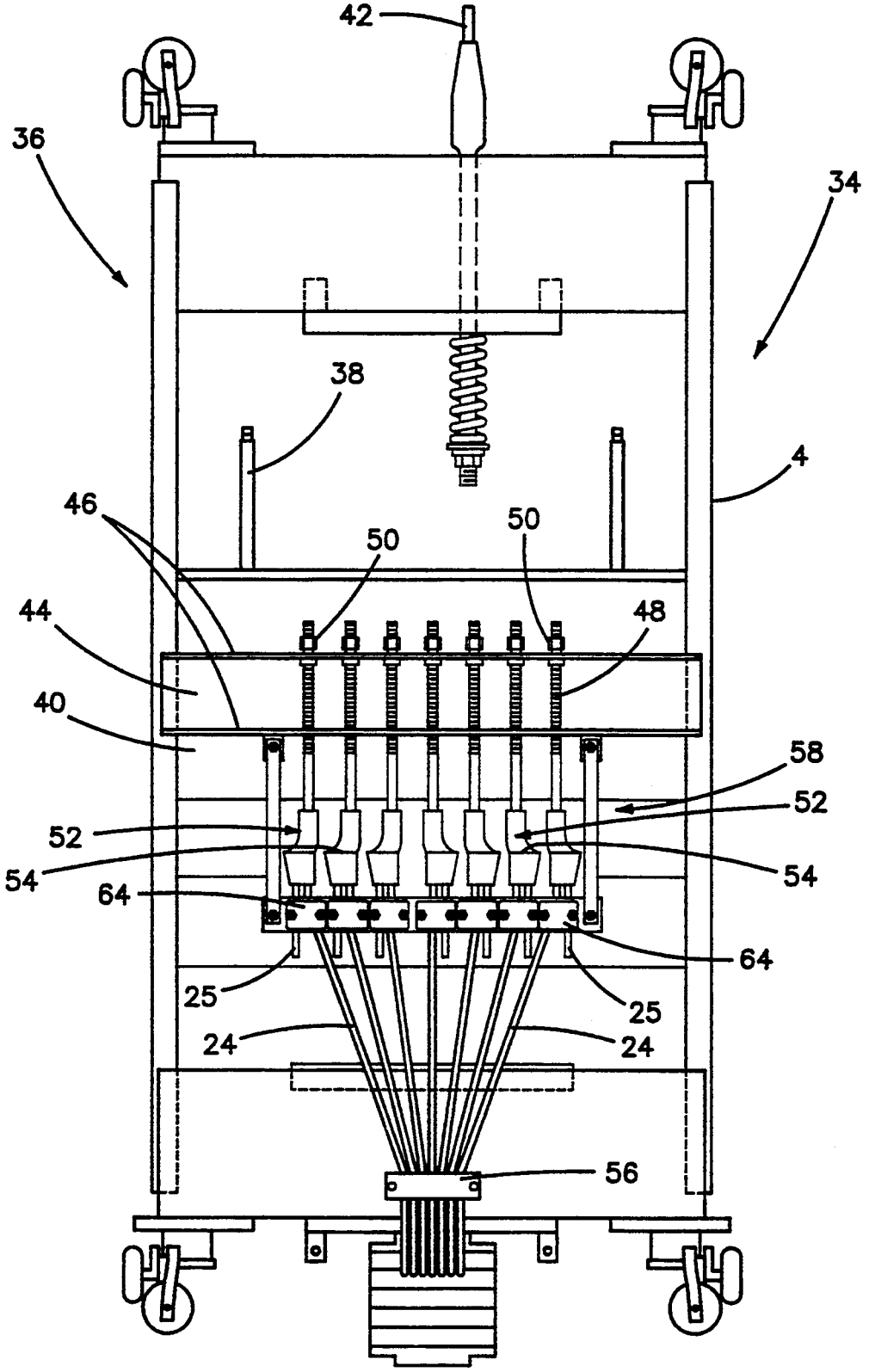
FIG. 6 is a front elevational view of an elevator counterweight assembly which includes an embodiment of the compensation rope hitch assembly of this invention.

It is preferred to use the more spread out configuration of the hitch assembly on the counterweight, as shown in FIG. 6, therefore, rather than using a single hitch block with one slot that receives all of the ropes 24, separate hitch blocks are used for each rope. The ropes 24 are gathered together in a bracket 56 at the bottom of the counterweight assembly 34 so as to descend into the pit with the same spacing as the cab assembly hitch. In order to thus gather the ropes 24, they must be deflected in varying degrees from the individual wedge blocks 52. This function is performed by a rope deflecting assembly mounted on the counterweight bracket 44, and denoted generally by the numeral 58. Details of the deflecting assembly are shown in FIGS. 7–10.

Figure 7:
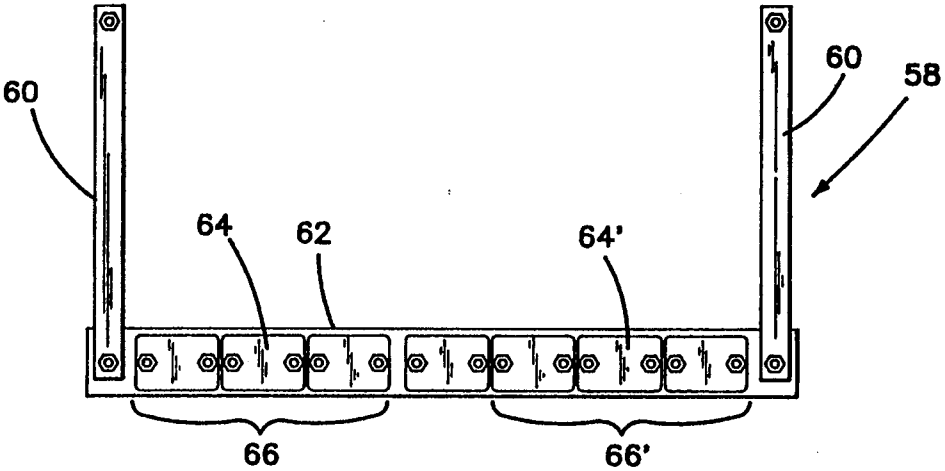
FIG. 7 is a front elevational view of the rope deflector assemblage used on the counterweight.
Figure 8:
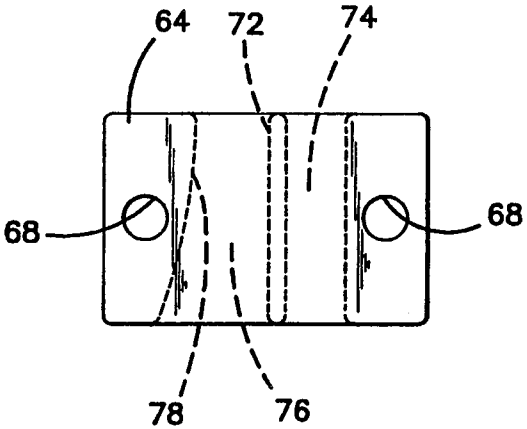
FIG. 8 is a front elevational view of one of the rope deflector blocks.
Figure 10:
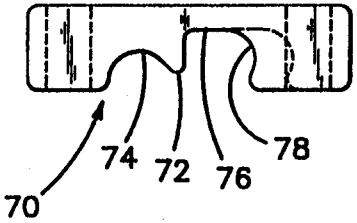
FIG. 10 is a top plan view of the block of FIG. 9.
Figure 9:
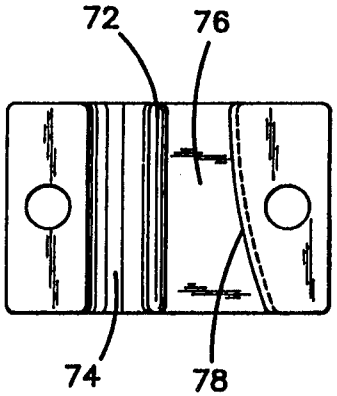
FIG. 9 is a back elevational view of the block of FIG. 8.

Referring now to FIG. 7, the deflecting assembly 58 includes a pair of straps 60 which are secured to and depend from the mounting bracket 44. A bar 62 extends between and is connected to the lower end of each of the straps 60. A series of rope deflecting blocks 64 and 64', which are arranged generally in left-hand and right-hand arrays 66 and 66', respectively, are mounted on the bar 62. Each of the blocks 64 (64') includes a pair of bolt holes 68 for fastening to the bar 62. The side 70 of the blocks 64 which faces the bar 62 is formed with a vertical medial rib 72, a vertical rectilinearly extending radiused slot 74 to one side of the rib 72, and a tapered slot 76 on the other side of the rib 72. The side wall 78 of the tapered slot 76 which is distal of the rib 72 curves vertically downwardly away from the rib 72, and is radiused so as to provide maximum contact with the compensation ropes. Thus, the surfaces of the slots 74 and 76 which contact the compensation ropes are radiused to provide maximum guidance and control of the compensation ropes.

Referring back to FIG. 6, it will be noted that the terminal end 25 of each compensation rope 24 extends from the wedge block 52 down through the slot 74 in the deflecting block 64, and the descending part of each rope 24 passes through the curvilinear slot 76 where it is guided inwardly toward the bracket 56. The blocks 64 thus serve to confine the free ends 25 of each of the compensation ropes 24, and to provide a positive and controlled deflecting surface for each of the ropes 24. The inwardly directed forces caused by the inward bends in the ropes 24 are neutralized by the blocks 64 and bar 62 so as to protect the thimble rods 48 from laterally directed bending forces.

It will be readily appreciated that the compensation rope hitch assembly of this invention allows the effective length of the ropes to be periodically adjusted in a simple and efficient manner, while providing a firm and secure connection between the ropes and the cab and counterweight assemblages during operation of the elevator. The counterweight hitch provides a laterally expansive connection with the counterweight frame plus a controlled rope deflection to the preferred closely gathered rope arrangement, the latter of which descends from the counterweight into the hoistway pit.

Since many changes and variations of the disclosed embodiments of the invention may be made without departing from the inventive concept, it is not intended to limit the invention otherwise than as required by the appended claims.

What is claimed is:

1. A hitch assembly for connecting elevator ropes to a component in an elevator, said hitch assembly comprising:

a) a one piece hitch block mounted on said component, said hitch block including a through passage extending therethrough from a top surface thereof to a bottom surface thereof, said through passage having opposed side walls adapted to engage an elevator rope, said opposed side walls converging toward each other from said top surface to said bottom surface of the hitch block, and said side walls being spaced apart from each other at said bottom surface of the hitch block by a distance which is greater than two times the diameter of the elevator rope;

b) a wedge-shaped insert dimensioned so as to fit within said hitch block through passage, said insert having an upper generally rounded surface and side surfaces merging into said upper surface, said side surfaces tapering toward each other in a downward direction; and c) said hitch block and insert combining to form a releasable entrapment for the elevator rope when a free end of the latter is passed upwardly into said hitch block through passage, looped over said upper surface of said insert, and passed downwardly through said hitch block through passage past the bottom surface of the hitch block, and said insert is positioned in said hitch block through passage within the rope loop.

2. A rope hitch assembly in an elevator comprising:

a) an elevator rope;

b) a one piece hitch block mounted on a component of the elevator, said hitch block having a top surface and a bottom surface, and a downwardly tapered through passage therein opening through said top and bottom surfaces;

c) a wedge-shaped insert removably telescoped into said hitch block through passage; and d) said elevator rope having a free end thereof which is passed upwardly through said hitch block through passage, looped around said insert, and passed downwardly through said hitch block through passage to project past said bottom surface of said hitch block, and said rope being wedged into and secured to said hitch block by reason of said insert preventing the rope loop from passing through the hitch block through passage bottom surface opening.

3. The elevator rope hitch assembly of claim 2 wherein said hitch block through passage and said insert have opposed concave side surfaces for engaging said rope.

4. The elevator rope hitch assembly of claim 2 wherein said hitch block through passage includes a plurality of adjacent tapered grooves, each of which grooves receiving a separate elevator rope, and wherein there is a separate insert telescoped into each of said tapered grooves so as to allow a plurality of elevator ropes to be attached to the elevator component with a single hitch block.

5. A hitch assembly for connecting elevator ropes to a component in an elevator, said hitch assembly comprising:

a) a one piece hitch block mounted on said component, said hitch block including a through passage extending therethrough from a top surface thereof to a bottom surface thereof, said through passage being formed with a plurality of adjacent grooves providing opposed side walls adapted to engage a plurality of elevator ropes, said opposed side walls converging toward each other from said top surface to said bottom surface of the hitch block, and said side walls being spaced apart from each other at said bottom surface of the hitch block by a distance which is greater than two times the diameter of the elevator rope;

b) a plurality of wedge-shaped inserts dimensioned so as to fit within said wedge block through passage grooves, said inserts each having an upper generally rounded surface and side surfaces merging into said upper surfaces, said side surfaces tapering toward each other in a downward direction; and c) said hitch block and inserts combining to form a releasable entrapment for a plurality of elevator ropes when a free end of each rope is passed upwardly into said hitch block through a passage groove, looped over said upper surface of an insert, and passed downwardly through said hitch block through an opposed passage groove past the bottom surface of the hitch block, and said inserts are positioned in said hitch block through passage grooves within the rope loops.

6. A rope hitch assembly for connecting ropes to a component of an elevator, said rope hitch assembly comprising:

a) a plurality of elevator ropes;

b) a plurality of adjacent one-piece hitch blocks mounted on a bracket which extends from substantially one side of the elevator component to the other, and which bracket is attached to the elevator component, each of said hitch blocks having a top surface and a bottom surface, and a downwardly tapered through passage therein opening through said top and bottom surfaces;

c) a plurality of wedge-shaped inserts, there being one of said inserts removably telescoped into each of said hitch block through passages;

d) each of said elevator ropes having a free end which is passed upwardly through respective ones of said hitch block through passages, looped around said inserts, and passed downwardly through said hitch block through passages to project past said bottom surfaces of said hitch blocks, and said ropes being wedged between and secured to said hitch blocks by reason of said inserts preventing the rope loops from passing through the hitch block through passage bottom surface openings; and e) a plurality of rope deflectors mounted below said bracket, there being one rope deflector disposed below each of said hitch blocks, each of said rope deflectors including a first vertical channel therein through which the free end of each associated rope passes, and a curvilinear channel through which each of the ropes is appropriately deflected by the curvilinear channels toward a central rope gathering bracket mounted on a lower portion of the elevator component.

* * * * *